United States Patent [19]

Russo

[11] 4,307,703

[45] Dec. 29, 1981

[54] STOVE DOOR ASSEMBLY FOR SHIELDING VIEWING WINDOW FROM FIREBOX INTERIOR

[75] Inventor: Richard A. Russo, Holbrook, Mass.

[73] Assignee: Russo Manufacturing Corp., Randolph, Mass.

[21] Appl. No.: 249,944

[22] Filed: Apr. 1, 1981

[51] Int. Cl.[3] ..... F23M 7/00

[52] U.S. Cl. ..... 126/200; 126/192; 126/193; 126/126

[58] Field of Search ..... 121/200, 190, 191, 192, 121/193, 198, 121, 126, 138, 141, 58, 60, 64, 65

[56] References Cited

U.S. PATENT DOCUMENTS

| | | | |
|---|---|---|---|
| 3,757,766 | 9/1973 | Stevenson | 126/200 |
| 4,136,662 | 1/1979 | Willson | 126/200 |
| 4,213,446 | 7/1980 | Stookey | 126/192 |

*Primary Examiner*—Albert W. Davis
*Assistant Examiner*—G. Anderson
*Attorney, Agent, or Firm*—Thompson, Birch, Gauthier & Samuels

[57] ABSTRACT

A stove has a firebox for burning solid fuels such as wood or coal, an opening in a side wall communicating with the firebox, a window housing surrounding the wall opening and protruding laterally from the stove, a transparent window pane mounted in the window housing in alignment with the wall opening and through which the interior of the firebox may be viewed, and a door assembly arranged in the window housing between the window pane and the wall opening. The door assembly includes a door having first and second panels, with hinges connecting the lower edge of the first door panel to the upper edge of the second door panel for pivotal movement about a first horizontal axis. Inclined track members extend downwardly along the interior sides of the window housing and inwardly away from the window pane. A handle accessible through a vent opening in the top of the window housing is employed to pivotally adjust the door between a raised open position exposing the window pane to the wall opening, and a lowered closed position at which the door panels are generally coplanar shielding the window pane from the wall opening and the firebox interior.

7 Claims, 9 Drawing Figures

STOVE DOOR ASSEMBLY FOR SHIELDING VIEWING WINDOW FROM FIREBOX INTERIOR

BACKGROUND OF THE INVENTION

This invention relates generally to a stove for burning solid fuels such as wood or coal, with a window for viewing the fire, and more particularly to an improved collapsible door assembly for shielding the window at selected times, such as when loading the stove with fuel.

Stoves of the above-mentioned type are well known, as shown for example by U.S. Pat. No. 3,757,766 (Stevenson). The present invention has as its primary objective the provision of an improved door assembly which affords a more positive and effective closure. Other objects of the present invention include the provision of a collapsible door assembly without exposed handles, tracks, etc. that detract from the appearance of the stove.

DESCRIPTION OF THE PREFERRED EMBODIMENT

Figure 1:
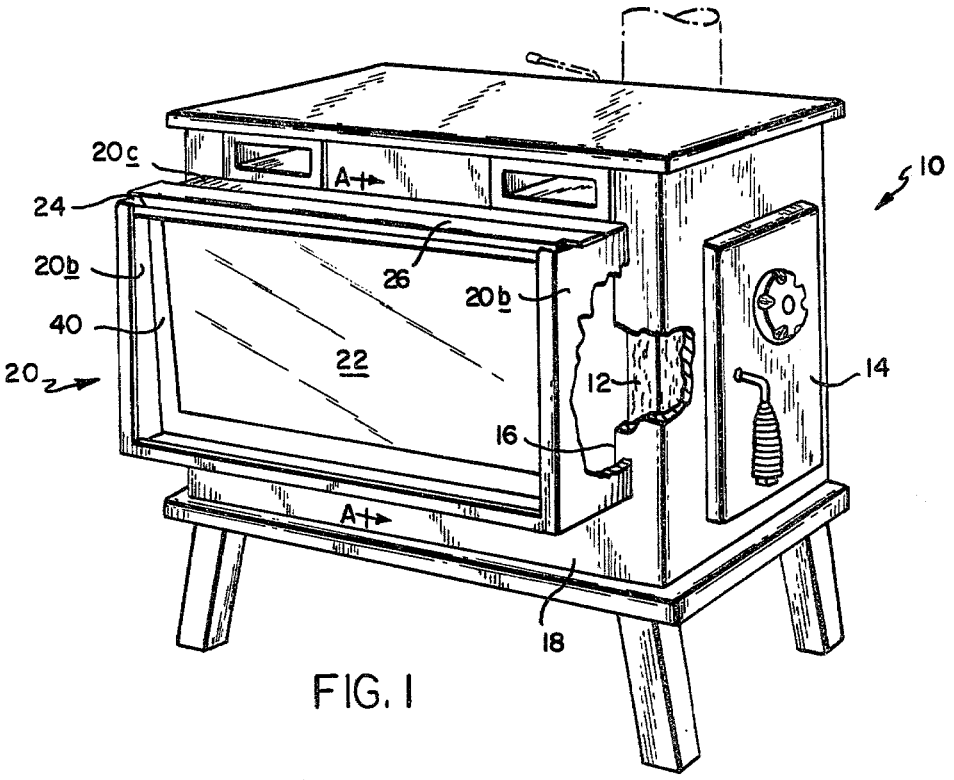
FIG. 1 is a perspective view of a stove having a door assembly in accordance with the present invention, with a portion broken away to show the interior firebox.

Referring now to the drawings, a stove 10 is shown having a generally box-like housing enclosing a firebox 12 in which solid fuels such as wood or coal may be burned. An access door 14 is provided for loading fuel into the firebox, and an opening 16 communicating with the firebox is provided in the stove front wall 18. The opening 16 is surrounded by a window housing 20 protruding laterally from the stove front wall. The window housing has a bottom **20*a*, side walls 20*b* and a top 20*c*. A transparent window pane 22 is mounted at the front of the window housing 20 in alignment with the opening 16, thus providing a means for viewing the firebox interior. The window housing top 20*c* is spaced from the window pane 22 to provide a vent opening 24 which can be opened or closed by a slidable cover plate 26**.

A door assembly generally indicated at 28 is arranged in the window housing 20 between the window pane 22 and the opening 16. The door assembly includes a door having first and second door panels 30, 32. The door panels 30, 32 are connected by hinges 34 located adjacent to their respective lower and upper edges for pivotal movement relative to each other about a first horizontal axis $A_1$. Interior brackets 36 receive laterally protruding pins 38 on the first door panel 30 and cooperate therewith to connect the first door panel to the window housing for pivotal movement about a second horizontal axis $A_2$ (see FIG. 6) which is arranged above the first horizontal axis $A_1$.

Inclined track members 40 extend downwardly along the interior of each side **20*b* of the window housing 20 and inwardly away from the window pane 22. As can be best seen in FIGS. 7 and 8, the track members 40 are arranged to be at least partially overlapped by the sides of the door panels 30, 32** when the door is closed.

Figure 2:
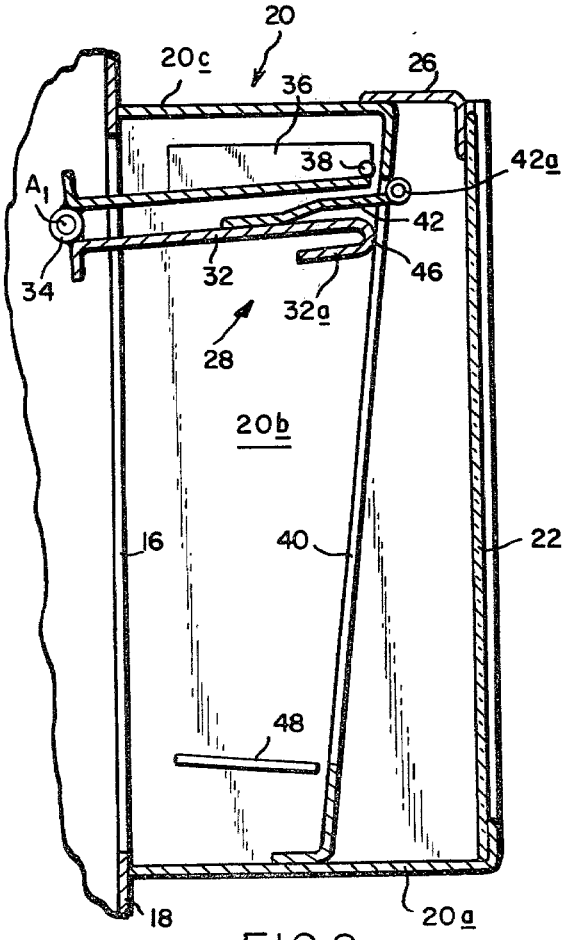
FIG. 2 is an enlarged cross-sectional view through the window housing taken along line A—A of FIG. 1 and showing the door in the collapsed open position.
Figure 5:
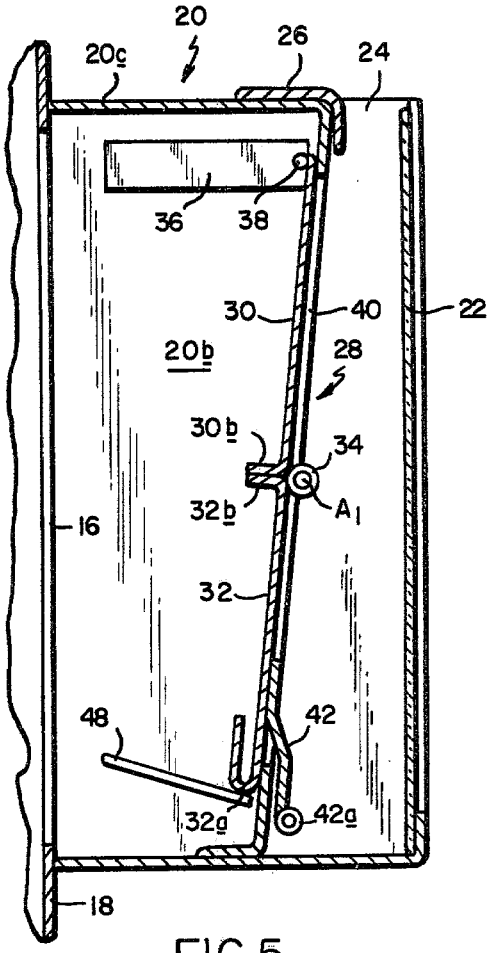
Figure 6:
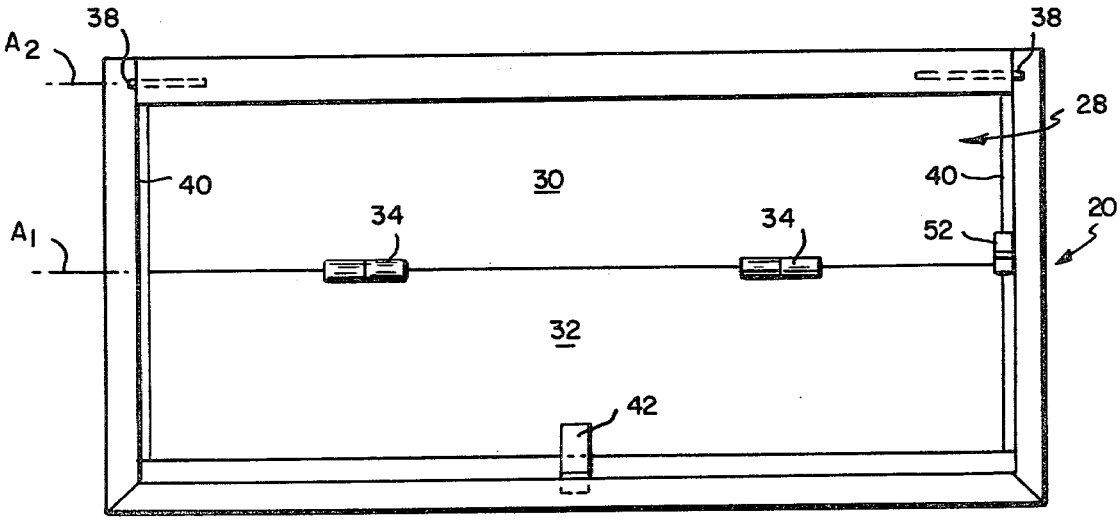
FIG. 6 is a frontal view of the window housing showing the door in the closed position.

An operating handle 42 having a receiving eye **42*a* is provided on the front surface of door panel 32. The handle is accessible through the vent opening 24 when the cover plate 26 is open as shown for example in FIGS. 3–5. The eye 42*a* is adapted to receive the laterally protruding end 44*a* of the tool 44 shown in solid lines in FIGS. 7–9 and in dot-dash lines in FIG. 3. With the tool 44 inserted through vent opening 24 into engagement with the eye 42*a* of handle 42, the door may be adjusted between a raised open position as shown in FIG. 2, and a lowered closed position as shown in FIGS. 5 and 6. When in the open position, the inturned lip 32*a* defining the lower edge of second door panel 32 is in contact as at 46 with upper sections of the inclined track members 40 and the door panels 30, 32 are in a generally confronting relationship extending rearwardly away from the track members towards and through the opening 16 in the stove front wall 18. The window pane 22 is thus exposed to the opening 16, thereby allowing the interior of the fire box 12 to be viewed through the window housing. When in the open position, the center of gravity of the door exerts a torque about the second axis $A_2$ (counterclockwise as viewed in FIG. 2) with an accompanying resultant force urging the lip 32*a* against the track members 40. Because of the inclination of the track members 40, this force has an upward vector which cooperates with frictional resistance in opposing downward movement of the lip 32*a***, thereby retaining the panels in the collapsed open position, without the need of auxiliary latches or the like.

Figure 3:
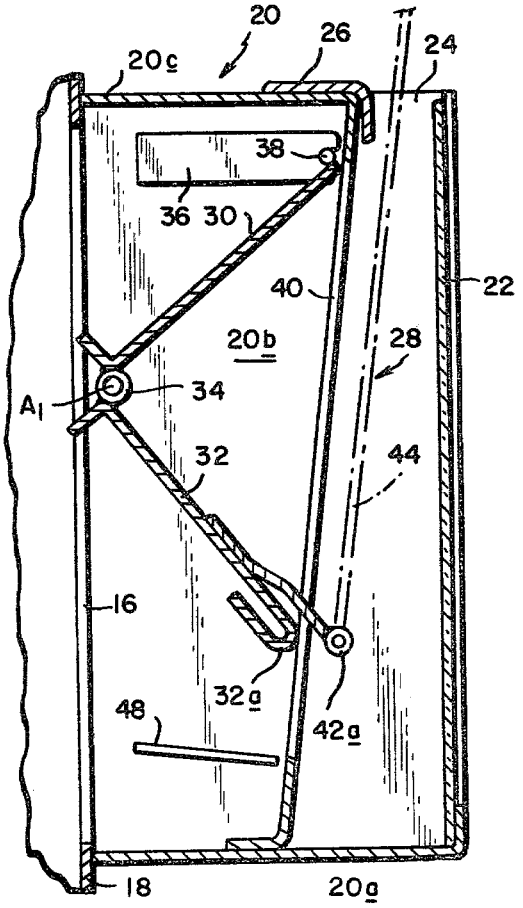
FIGS. 3, 4 and 5 are views similar to FIG. 1 showing the door at different stages of adjustment between the open and closed positions.

When adjusting the door to the lowered closed position, the tool 44 is employed to exert a downward force on the handle 42. FIG. 3 shows an intermediate stage in the lowering of the door with the lip **32*a* riding down the inclined track members 40**.

Figure 4:
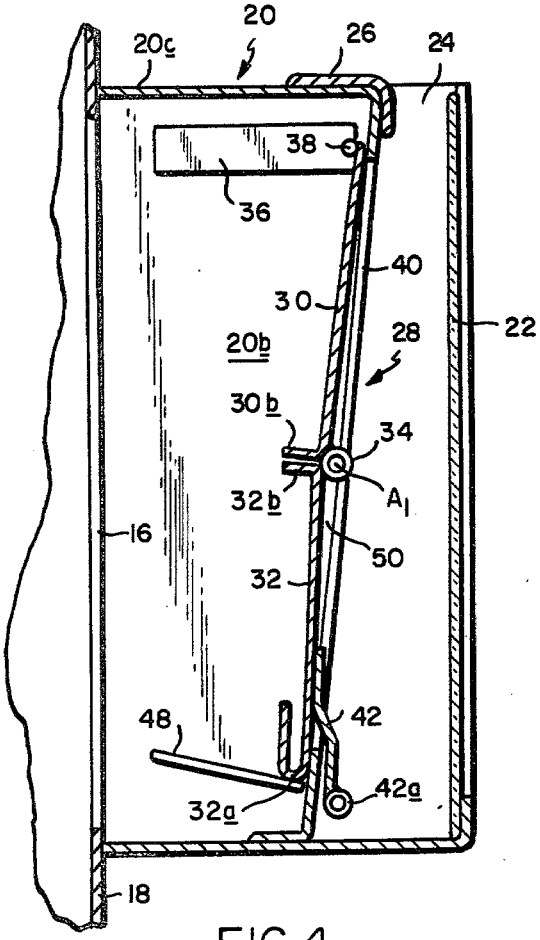

In FIG. 4, the lip **32*a* is shown at rest on resilient leaf springs 48 mounted on the interior faces of the side walls 20*b*. At this stage, the door is nearly closed, but there remains a space 50 between the front surface of the door panels and the inclined track members 40. Also, the axis $A_1$ remains located inwardly of the track members 40 on the side facing the opening 16**.

A sharp downward force is required to push the door to its final closed position as shown in FIG. 5. When in this position, the axis $A_1$ has moved across the track members 40 to the side facing the window pane 22, the door panels are flush against the track members, and the leaf springs 48 have been deflected downwardly by the lower lip **32*a*. The door is thus retained in the closed position by the resilient force of the leaf springs 48 which act in the lower lip 32*a* to urge the axis $A_1$ towards the window pane 22**.

Figure 7:
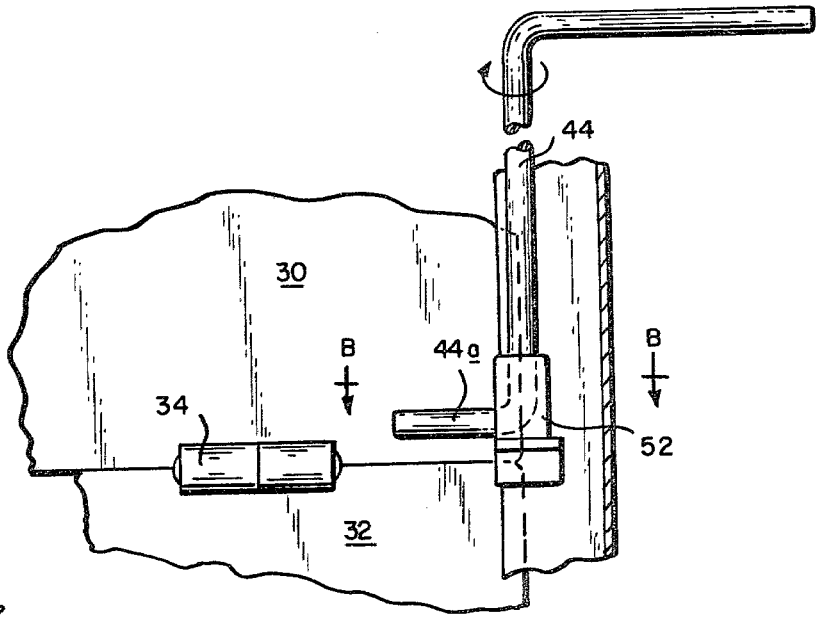
FIG. 7 is an enlarged elevational view, partially in section, of a hinge portion of the door with a detachable tool being employed to push the door towards the open position.
Figure 8:
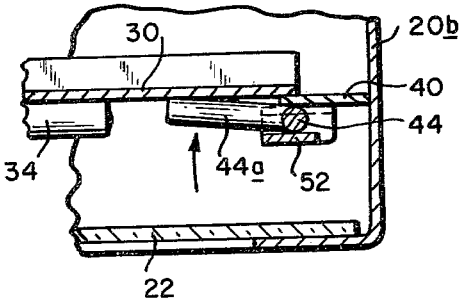
FIGS. 8 and 9 are sectional views taken along line B—B of FIG. 7 showing how the tool is manipulated.
Figure 9:
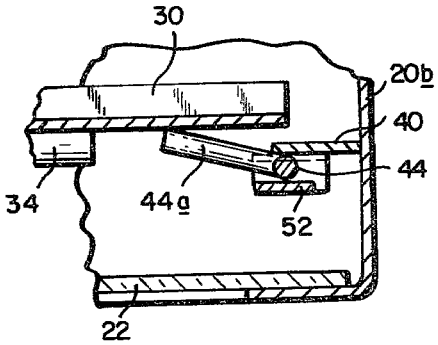

In order to open the door, the resilient force of the springs first must be overcome, and the axis $A_1$ shifted back across the track members 40 to the side facing opening 16. To this end, as is best shown in FIGS. 7–9, a bracket 52 is secured to the front face of one of the track members 40 at a location closely adjacent to the level at which the hinges 34 are located when the door is closed. By inserting the tool 44 between the track and bracket and exerting a torque (clockwise as viewed in FIGS. 8 and 9), the tool end 44*a* is used to push the door rearwardly away from the window panel. The rearward force thus applied to the door is sufficient to overcome the resilient force of leaf springs 48, and the axis $A_1$ accordingly is shifted rearwardly from the portion shown in FIG. 8 (corresponds to FIG. 5) to the position shown in FIG. 9 (corresponds to FIG. 4). Once this has been accomplished, the tool end 44*a* can be engaged with the eye 42*a* of handle 42, and the door pulled upwardly to its open position.

I claim:

1. In a stove having a firebox for burning solid fuels such as wood or coal, an opening communicating with said firebox, a window housing surrounding said opening and protruding laterally from said stove, and a transparent window pane mounted in said housing in alignment with said opening and through which the interior of the firebox may be viewed, a door assembly arranged in said window housing between said window pane and said opening, said door assembly comprising:

a door having first and second panels, with hinge means connecting the lower edge of said first panel to the upper edge of said second panel for pivotal movement about a first horizontal axis;

means for connecting said first panel to said window housing for pivotal movement about a second horizontal axis arranged above said first horizontal axis;

inclined track members extending downwardly along the interior sides of said window housing and inwardly away from said window pane, said track members being arranged to be at least partially overlapped by the sides of said door panels; and handle means accessible through a vent opening in the top of said window housing for pivotally adjusting said door between a raised open position at which the lower edge of said second door panel is in contact with upper sections of said track members and said door panels are in a generally confronting relationship extending rearwardly away from said track members towards said opening, thus exposing said window pane to said opening, and a lowered closed position at which said door panels are arranged in a generally coplanar relationship substantially parallel to and at rest against said track members, thereby shielding said window pane from said opening.

2. The door assembly of claim 1 wherein when said door is in said raised open position, the center of gravity of said door exerts a torque about said second axis with a resultant force urging the lower edge of said second door panel against said track members.

3. The door assembly of claim 2 wherein the inclination of said track members causes said resultant force to have an upwardly directed vector which cooperates with frictional resistance to oppose downward movement of the lower edge of said second door panel.

4. The door assembly of claim 1 wherein when said door is in said open position, said first axis is on the side of said track members facing said opening, and when said door is in said closed position, said first axis is on the opposite side of said track members facing said window pane.

5. The door assembly of claim 4 further comprising spring means engageable by the lower edge of said second panel for resiliently urging said door into said closed position.

6. The door assembly of claim 1 wherein said handle means is fixed to the front surface of said second door panel.

7. The door assembly of claim 6 further comprising an upstanding flange extending along the bottom of said window housing between said track members, and wherein when said door is in said closed position, the lower edge of said second panel and said handle means are on opposite sides respectively of said flange.

* * * * *